US006520132B2

(12) United States Patent
Todo

(10) Patent No.: US 6,520,132 B2
(45) Date of Patent: Feb. 18, 2003

(54) VALVE TIMING CONTROL SYSTEM OF INTERNAL COMBUSTION ENGINE

(75) Inventor: Tamotsu Todo, Kanagawa (JP)

(73) Assignee: Unisia Jecs Corporation, Atsugi (JP)

( * ) Notice: Subject to any disclaimer, the term of this patent is extended or adjusted under 35 U.S.C. 154(b) by 0 days.

(21) Appl. No.: 10/114,063

(22) Filed: Apr. 3, 2002

(65) Prior Publication Data

US 2002/0152978 A1 Oct. 24, 2002

(30) Foreign Application Priority Data

Apr. 20, 2001 (JP) ..... 2001-122046

(51) Int. Cl.[7] ..... F01L 1/344
(52) U.S. Cl. ..... 123/90.17; 123/90.19
(58) Field of Search ..... 123/90.15, 90.17, 123/90.19, 90.31; 74/568 R; 464/1, 2, 160

(56) References Cited

U.S. PATENT DOCUMENTS 5,816,204 A * 10/1998 Moriya et al. ..... 123/90.17
5,823,152 A * 10/1998 Ushida ..... 123/90.17
5,832,887 A 11/1998 Adachi et al.
5,845,615 A * 12/1998 Nakamura et al. ..... 123/90.17
6,386,164 B1 * 5/2002 Mikame et al. ..... 123/90.17
6,431,131 B1 * 8/2002 Hosoya et al. ..... 123/90.15
6,443,112 B1 * 9/2002 Kinugawa ..... 123/90.17

FOREIGN PATENT DOCUMENTS

JP 10-110603 4/1998

* cited by examiner

*Primary Examiner*—Weilun Lo
(74) *Attorney, Agent, or Firm*—Foley & Lardner

(57) ABSTRACT

A valve timing control system of an internal combustion engine has: a drive force conveyer; a cam shaft; a housing rotating integrally with one of the drive force conveyer and the cam shaft; a vane rotor housed in the housing, the vane rotor rotating integrally with the other of the drive force conveyer and the cam shaft; an advanced angle chamber and a retarded angle chamber housed in the housing, and turning the vane rotor with an oil pressure; an oil pressure supply-drain measure; a lock gear; and an unlock gear. A large diameter section of a lock pin and an inner periphery of a pin hole define a first clearance while a small diameter section of the lock pin and the inner periphery of the pin hole define a second clearance, such that the first clearance is larger than the second clearance.

14 Claims, 7 Drawing Sheets

VALVE TIMING CONTROL SYSTEM OF INTERNAL COMBUSTION ENGINE

BACKGROUND OF THE INVENTION

1. Field of the Invention

The present invention relates to a valve timing control system for controlling open/close timing of an intake valve and/or an exhaust valve, in accordance with operating condition of an internal combustion engine.

2. Description of the Related Art

U.S. Pat. No. 5,832,887 {equivalent of Japanese Patent Unexamined Publication No. Heisei 10 (1998)-110603} discloses a valve timing control system (referred to as "rotational phase adjusting apparatus" in the above Publication) for variably controlling open/close timing of an intake valve or an exhaust valve of an internal combustion engine. The above variable control is carried out by rotating an angle of a drive force conveyer (including a timing pulley, a chain sprocket and the like synchronously rotating with a crank shaft of the internal combustion engine) relative to a cam shaft (having an outer periphery formed with a drive cam).

The valve timing control system disclosed in U.S. Pat. No. 5,832,887 has a housing on a side defining the drive force conveyer. A vane rotor is integrated with an end of the cam shaft, and is housed in the housing. Also housed in the housing are an advanced angle chamber and a retarded angle chamber. Supplying an oil pressure to and draining the oil pressure from each of the advanced angle chamber and the retarded angle chamber allows the vane rotor to rotate relative to the housing, to thereby vary a rotational phase of the drive force conveyer relative to the cam shaft. With this, the open/close timing of the intake valve or the exhaust valve of the internal combustion engine is controlled.

Moreover, for improving startability of the internal combustion engine, overlap of the intake valve with the exhaust valve is to be reduced. Therefore, the valve timing control system according to U.S. Pat. No. 5,832,887 is provided with a lock gear which mechanically locks, during engine stop, the vane rotor and the housing at an angle where the overlap is minimized (for the intake valve, a most retarded angle; while for the exhaust valve, a most advanced angle).

More specifically, as is seen in FIG. 10, a vane rotor 1 has a vane section which is provided with a lock pin 2 moving forward and backward (respectively, leftward and rightward in FIG. 10). A spring 3 biases lock pin 2 in a direction of protrusion (leftward in FIG. 10). On the other hand, on a side having a housing 5, there is defined a lock hole 4 which mates with lock pin 2 at an initial position (where the overlap of the intake valve with the exhaust valve is minimized). Therefore, returning vane rotor 1 to the initial position during the engine stop allows lock pin 2 to protrude, with a biasing force applied to lock pin 2 from spring 3. With this, a head end (left end in FIG. 10) of lock pin 2 engages with lock hole 4.

Furthermore, the valve timing control system according to U.S. Pat. No. 5,832,887 is provided with an unlock gear for unlocking, after the start of the internal combustion engine, the lock condition by the lock gear. The unlock gear allows the oil pressure of each of the advanced angle chamber and the retarded angle chamber to act on lock pin 2 for the unlocking. More specifically, on a side having vane rotor 1, a pin hole 6 for receiving lock pin 2 is in a form of a two-step hole, namely, constituted of a small diameter hole 6*a* and a large diameter hole 6*b*. On the other hand, the lock pin 2 is constituted of a small diameter section 2*a* and a large diameter section 2*b*. Small diameter section 2*a* is disposed at the head end (left in FIG. 10) of lock pin 2, for mating in and coming out of small diameter hole 6*a*. Large diameter section 2*b* is larger than small diameter section 2*a*, and in a form of a flange. Large diameter section 2*b* is received in large diameter hole 6*b* at a bottom end (right in FIG. 10).

The oil pressure of one of the advanced angle chamber and the retarded angle chamber is supplied to the base (left in FIG. 10) of lock hole 4. Contrary to this, the oil pressure of the other of the advanced angle chamber and the retarded angle chamber is supplied to an annular space 7 which is defined between a stepped face {formed between large diameter hole 6*b* and small diameter hole 6*a* (of pin hole 6)} and large diameter section 2*b* (of lock pin 2).

When the oil pressure of one of the advanced angle chamber and the retarded angle chamber is increased, with lock pin 2 engaging with lock hole 4 (lock condition), the oil pressure acts against the force of spring 3 in such a manner as to move lock pin 2 backward (rightward in FIG. 10).

In the valve timing control system according to U.S. Pat. No. 5,832,887, when the relative rotation of vane rotor 1 and housing 5 reaches the initial position, lock pin 2 is to assuredly engage with lock hole 4. It is difficult, however, to completely align pin hole 6 and lock hole 4 on an axis at the initial position.

In other words, for aligning pin hole 6 and lock hole 4 on the axis at the initial position; production accuracy/precision and assembly accuracy/precision of housing 5 and vane rotor 1 are increased, likewise, machining accuracy/precision and the like of pin hole 6 and lock hole 4 are increased. Increasing the accuracy/precision as described above is not feasible with the present technology.

Thereby, according to U.S. Pat. No. 5,832,887, small diameter hole 6*a* is larger than small diameter section 2*a*, while large diameter hole 6*b* is larger than large diameter section 2*b*. Moreover, according to U.S. Pat. No. 5,832,887, a clearance d is so defined between lock pin 2 and pin hole 6 as to absorb an axial shift of pin hole 6 from lock hole 4.

According to U.S. Pat. No. 5,832,887, however, the clearance d is common in dimension to the following two:

1. between small diameter section 2*a* and small diameter hole 6*a*, and
2. between large diameter section 2*b* and large diameter hole 6*b*.

Thereby, allowing the oil pressure (for unlocking) to act on lock pin 2 when lock pin 2 engages with pin hole 6 with an inclination causes an edge E of large diameter section 2*b* to abut on an inner periphery of large diameter hole 6*b*, as is seen in FIG. 10 (partly enlarged area). The abutment of edge E may prevent smooth removal of lock pin 2 from pin hole 6.

BRIEF SUMMARY OF THE INVENTION

It is an object of the present invention to provide a valve timing control system for an internal combustion engine.

It is another object of the present invention to provide the valve timing control system having a lock pin which assuredly engages with a lock hole at an initial position (where an overlap of an intake valve with an exhaust valve is minimized), and achieving a smooth unlocking operation.

It is still another object of the present invention to allow the valve timing control system to have a vane rotor which is free from causing flapping at the initial position, and to smoothen rotational phase variation.

According to a first aspect of the present invention, there is provided a valve timing control system of an internal combustion engine. The valve timing control system comprises:

a drive force conveyer driven by a crank shaft of the internal combustion engine;

a cam shaft having an outer periphery formed with a drive cam for driving a valve of the internal combustion engine, the drive force conveyer being mounted to the cam shaft in such a manner as to make a rotation relative to the cam shaft when so requested, the cam shaft receiving a drive force from the drive force conveyer to rotate as a follower;

a housing rotating integrally with one of the drive force conveyer and the cam shaft;

a vane rotor housed in the housing, the vane rotor rotating integrally with the other of the drive force conveyer and the cam shaft;

an advanced angle chamber and a retarded angle chamber housed in the housing, and turning the vane rotor with an oil pressure;

an oil pressure supply-drain measure for supplying the oil pressure to the advanced angle chamber and the retarded angle chamber and for draining the oil pressure from the advanced angle chamber and the retarded angle chamber, the oil pressure supply-drain measure carrying out the supplying and the draining of the oil pressure selectively for the advanced angle chamber and the retarded angle chamber;

a lock gear formed with a lock hole, the lock gear including a lock pin having a small diameter section and a large diameter section, the lock pin received in a pin hole in such a manner as to emerge and submerge, the pin hole being formed in one of the vane rotor and the housing, the lock pin having a head end adapted to engage with the lock hole which is formed in the other of the vane rotor and the housing, the head end and the lock hole, when thus engaged, locking a relative rotation of the vane rotor and the housing at one of a most retarded angle and a most advanced angle; and an unlock gear for disengaging the lock pin from the lock hole with the oil pressure conveyed from one of the advanced angle chamber and the retarded angle chamber to a pressure face of the lock pin.

The pin hole includes:

a head side on which the lock pin is engaged with and disengaged from, the head side forming a small diameter hole, and a bottom side opposite to the head side, and forming a large diameter hole which is larger than the small diameter hole.

The lock pin includes:

a small diameter section on a head side of the lock pin, the small diameter section being disposed toward the lock hole, and a large diameter section on a bottom side of the lock pin opposite to the head side of the lock pin, the large diameter section being increased in diameter in such a manner as to form a stepped face relative to the small diameter section.

The pressure face of the lock pin includes:

a face defined on a head side of the small diameter section, and subjected to the oil pressure from the one of the advanced angle chamber and the retarded angle chamber, and the stepped face of the large diameter section, the stepped face facing the small diameter section and being subjected to the oil pressure from the other of the advanced angle chamber and the retarded angle chamber.

The large diameter section of the lock pin and an inner periphery of the pin hole define a first clearance while the small diameter section of the lock pin and the inner periphery of the pin hole define a second clearance, such that the first clearance is larger than the second clearance.

According to a second aspect of the present invention, there is provided a valve timing control system of an internal combustion engine. The valve timing control system comprises:

a drive force conveyer driven by a crank shaft of the internal combustion engine;

a cam shaft having an outer periphery formed with a drive cam for driving a valve of the internal combustion engine, the drive force conveyer being mounted to the cam shaft in such a manner as to make a rotation relative to the cam shaft when so requested, the cam shaft receiving a drive force from the drive force conveyer to rotate as a follower;

a housing rotating integrally with one of the drive force conveyer and the cam shaft;

a vane rotor housed in the housing, the vane rotor rotating integrally with the other of the drive force conveyer and the cam shaft;

an advanced angle chamber and a retarded angle chamber housed in the housing, and turning the vane rotor with an oil pressure;

an oil pressure supply-drain measure for supplying the oil pressure to the advanced angle chamber and the retarded angle chamber and for draining the oil pressure from the advanced angle chamber and the retarded angle chamber, the oil pressure supply-drain measure carrying out the supplying and the draining of the oil pressure selectively for the advanced angle chamber and the retarded angle chamber;

a lock gear formed with a lock hole, the lock gear including a lock pin having a small diameter section and a large diameter section, the lock pin received in a pin hole in such a manner as to emerge and submerge, the pin hole being formed in one of the vane rotor and the housing, the lock pin having a head end adapted to engage with the lock hole which is formed in the other of the vane rotor and the housing, the head end and the lock hole, when thus engaged, locking a relative rotation of the vane rotor and the housing at one of a most retarded angle and a most advanced angle; and an unlock gear for disengaging the lock pin from the lock hole with the oil pressure conveyed from one of the advanced angle chamber and the retarded angle chamber to a pressure face of the lock pin.

The pin hole includes:

a head side on which the lock pin is engaged with and disengaged from, the head side forming a small diameter hole, and a bottom side opposite to the head side, and forming a large diameter hole which is larger than the small diameter hole.

The lock pin includes:

a small diameter section on a head side of the lock pin, the small diameter section being disposed toward the lock hole, and a large diameter section on a bottom side of the lock pin opposite to the head side of the lock pin, the large diameter section being increased in diameter in such a manner as to form a stepped face relative to the small diameter section.

The pressure face of the lock pin includes:

a face defined on a head side of the small diameter section, and subjected to the oil pressure from the one of the advanced angle chamber and the retarded angle chamber, and the stepped face of the large diameter section, the stepped face facing the small diameter section and being subjected to the oil pressure from the other of the advanced angle chamber and the retarded angle chamber.

The lock pin comprises:

a lock pin body extending from the small diameter section on the head side of the lock pin, in such a manner as to form substantially a straight and constant outer diameter, the bottom side of the lock pin having an outer periphery formed with an annular groove; and a ring member mounted to the annular groove in such a manner as to constitute a large diameter section of the lock pin, the ring member having a resilient force in a direction for increasing the ring member in diameter and being deformable in a direction for reducing the ring member in diameter.

According to a third aspect of the present invention, there is provided a valve timing control system of an internal combustion engine. The valve timing control system comprises:

a drive force conveyer driven by a crank shaft of the internal combustion engine;

a cam shaft having an outer periphery formed with a drive cam for driving a valve of the internal combustion engine, the drive force conveyer being mounted to the cam shaft in such a manner as to make a rotation relative to the cam shaft when so requested, the cam shaft receiving a drive force from the drive force conveyer to rotate as a follower;

a housing rotating integrally with one of the drive force conveyer and the cam shaft;

a vane rotor housed in the housing, the vane rotor rotating integrally with the other of the drive force conveyer and the cam shaft;

an advanced angle chamber and a retarded angle chamber housed in the housing, and turning the vane rotor with an oil pressure;

an oil pressure supply-drain measure for supplying the oil pressure to the advanced angle chamber and the retarded angle chamber and for draining the oil pressure from the advanced angle chamber and the retarded angle chamber, the oil pressure supply-drain measure carrying out the supplying and the draining of the oil pressure selectively for the advanced angle chamber and the retarded angle chamber;

a lock gear formed with a lock hole, the lock gear including a lock pin having a small diameter section and a large diameter section, the lock pin received in a pin hole in such a manner as to emerge and submerge, the pin hole being formed in one of the vane rotor and the housing, the lock pin having a head end adapted to engage with the lock hole which is formed in the other of the vane rotor and the housing, the head end and the lock hole, when thus engaged, locking a relative rotation of the vane rotor and the housing at one of a most retarded angle and a most advanced angle; and an unlock gear for disengaging the lock pin from the lock hole with the oil pressure conveyed from one of the advanced angle chamber and the retarded angle chamber to a pressure face of the lock pin.

The pin hole includes:

a head side on which the lock pin is engaged with and disengaged from, the head side forming a small diameter hole, and a bottom side opposite to the head side, and forming a large diameter hole which is larger than the small diameter hole.

The lock pin includes:

a small diameter section on a head side of the lock pin, the small diameter section being disposed toward the lock hole, and a large diameter section on a bottom side of the lock pin opposite to the head side of the lock pin, the large diameter section being increased in diameter in such a manner as to form a stepped face relative to the small diameter section.

The pressure face of the lock pin includes:

a face defined on a head side of the small diameter section, and subjected to the oil pressure from the one of the advanced angle chamber and the retarded angle chamber, and the stepped face of the large diameter section, the stepped face facing the small diameter section and being subjected to the oil pressure from the other of the advanced angle chamber and the retarded angle chamber.

The large diameter section of the lock pin is radially movable relative to the pin hole in a range wider than the small diameter section of the lock pin is radially movable relative to the pin hole.

The other objects and features of the present invention will become understood from the following description with reference to the accompanying drawings.

DETAILED DESCRIPTION OF THE EMBODIMENTS

In the following, various embodiments of the present invention will be described in detail with reference to the accompanying drawings.

For ease of understanding, the following description will contain various directional terms, such as, left, right, upper, lower and the like. However, such terms are to be understood with respect to only a drawing or drawings on which the corresponding part of element is illustrated.

Figure 1:
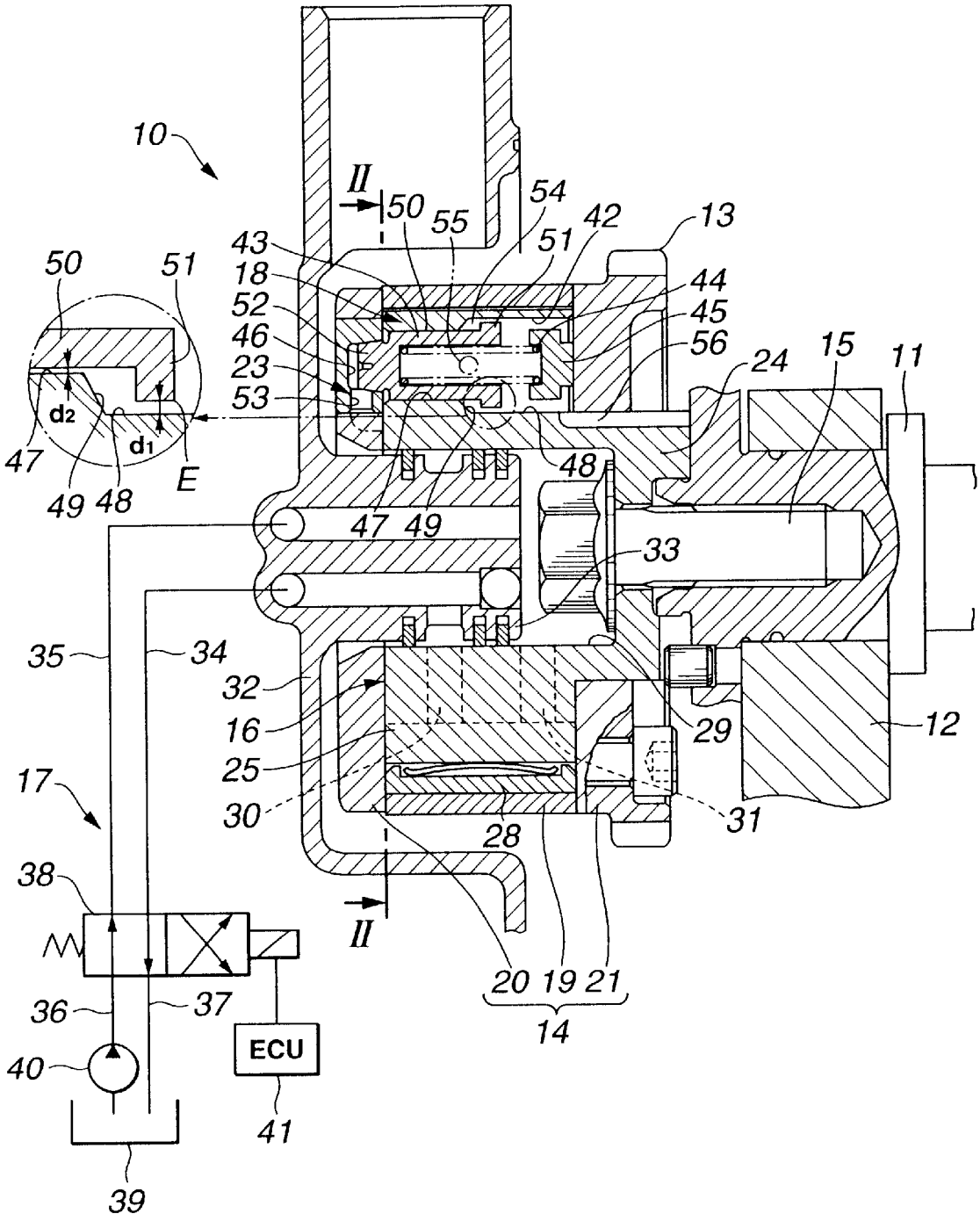
FIG. 1 is a cross section of a valve timing control system 10 taken along lines 1—1 in FIG. 2, according to a first embodiment of the present invention.
Figure 2:
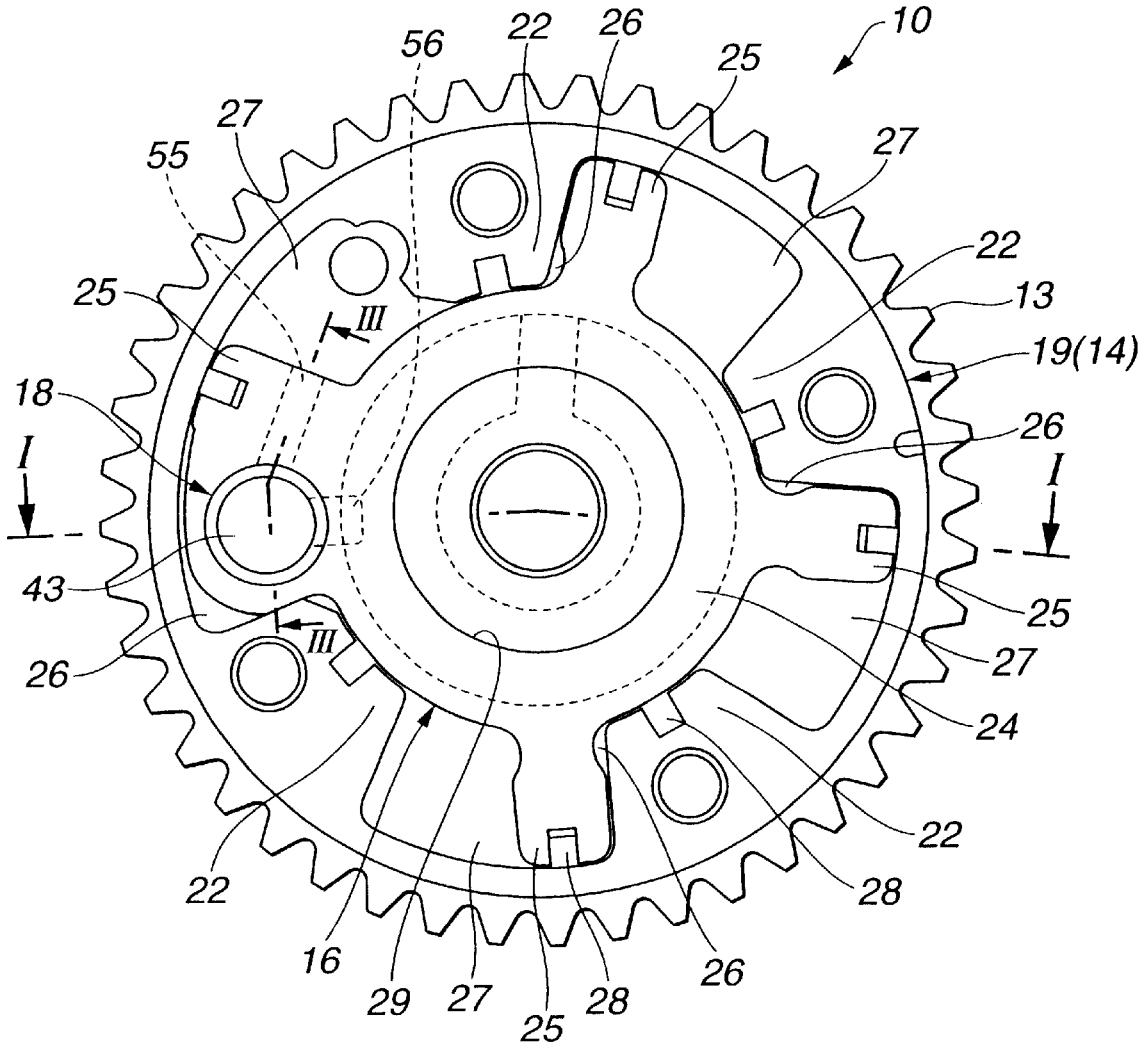
FIG. 2 is a cross section taken along lines II—II in FIG. 1, according to the first embodiment.
Figure 3:
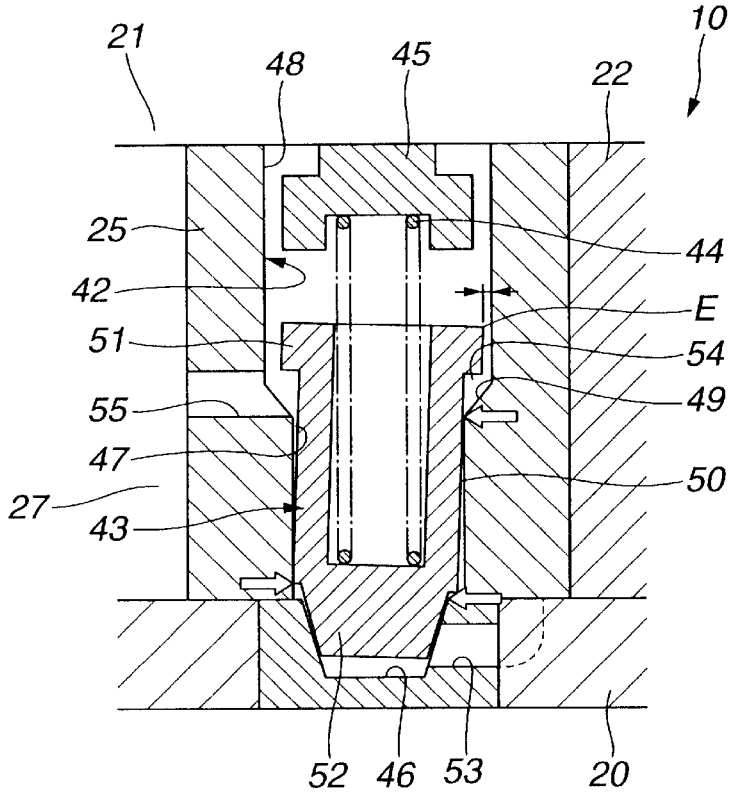
FIG. 3 is a cross section taken along lines III—III in FIG. 2, according to the first embodiment.

As is seen in FIG. 1 to FIG. 3, there is provided a valve timing control system 10, according to a first embodiment of the present invention.

In FIG. 1, there is shown a cam shaft 11 of an internal combustion engine. Cam shaft 11 is rotatably supported to a cylinder head 12. Cam shaft 11 has a base section having an outer periphery provided with a drive cam (not shown) for opening and closing an intake valve of the internal combustion engine. Valve timing control system 10 under the present invention is disposed at a front end (left in FIG. 1) of cam shaft 11.

Valve timing control system 10 is constituted of a chain sprocket 13 (referred to as "drive force conveyer" in WHAT IS CLAIMED IS), a housing 14, cam shaft 11, a vane rotor 16, an oil pressure supply-drain measure 17, a lock gear 18, and an unlock gear 23:

Chain sprocket 13 acts as a drive force conveyer which is rotated, by way of a timing chain (not shown) and the like, with a crank shaft (not shown) of the internal combustion engine. Housing 14 is integrated with chain sprocket 13. Cam shaft 11 has a first end (left in FIG. 1) to which housing 14 is mounted in such a manner that housing 14 can rotate when so requested. Vane rotor 16 is coupled, with a cam bolt 15, to the first end (left end in FIG. 1) of cam shaft 11, and is rotatably housed in housing 14. With an oil pressure, oil pressure supply-drain measure 17 turns vane rotor 16 in a first direction and a second direction (opposite to the first direction) in accordance with operating condition of the internal combustion engine. Lock gear 18 locks a relative rotation between housing 14 and vane rotor 16, when, for example, the internal combustion engine is started. Unlock gear 23 unlocks the above lock condition (by lock gear 18) of housing 14 and vane rotor 16.

Housing 14 is constituted of a housing body 19, a front cover 20, and a rear cover 21. Housing body 19 is substantially cylindrical. Front cover 20 is coupled, with a bolt, to a front end face (left in FIG. 1) of housing body 19, while rear cover 21 is coupled, with a bolt, to a rear end face (right in FIG. 1) of housing body 19. As is seen in FIG. 2, housing body 19 has an inner periphery formed with protruding four partition walls 22, each of which forms a cross section shaped substantially into a trapezium. Four partition walls 22 are disposed at angular intervals of substantially 90°.

On the other hand, vane rotor 16 is constituted of a shell section 24 and four vane sections 25. Shell section 24 is substantially cylindrical, and is coupled, with cam bolt 15, to the front end (left in FIG. 1) of cam shaft 11. As is seen in FIG. 2, shell section 24 has an outer periphery formed with four vane sections 25 protruding radially at angular intervals of substantially 90°. Shell section 24 is disposed at an axial center of housing 14. Each of vane sections 25 is disposed between two adjacent partition walls 22 of housing 14.

An advanced angle chamber 26 is formed between a first side face (of each of vane sections 25) and partition wall 22 (opposed to the first side face of each of vane sections 25), while a retarded angle chamber 27 is formed between a second side face (of each of vane sections 25) and partition wall 22 (opposed to the second side face of each of vane sections 25). Thereby, valve timing control system 10 is formed with four pairs of advanced angle chambers 26 and retarded angle chambers 27. Each of vane section 25 and partition wall 22 has a head end formed with a seal member 28 which is biased by a spring, to thereby maintain fluid tightness between advanced angle chamber 26 and retarded angle chamber 27 that are adjacent to each other.

There is formed a connecting hole 29 in the center at a front end (left in FIG. 1) of shell section 24 of vane rotor 16. Connecting hole 29 has a bottom section (right in FIG. 1) which is provided with a head section of cam bolt 15 for coupling vane rotor 16 to cam shaft 11. Connecting hole 29 has an inner periphery which is formed with an end of a first radial hole 30 communicating to each of advanced angle chambers 26, and formed with an end of a second radial hole 31 communicating to each of retarded angle chambers 27.

A valve timing control system cover 32 is mounted to a front end (left in FIG. 1) of cylinder head 12. Valve timing control system cover 32 has a supply-drain passage shaft 33 which is substantially cylindrical and is so inserted into connecting hole 29 of vane rotor 16 as to make a relative rotation. By way of supply-drain passage shaft 33, an operation oil is supplied to advanced angle chamber 26 and retarded angle chamber 27, and drained from advanced angle chamber and retarded angle chamber 27.

As is seen in FIG. 1, oil pressure supply-drain measure 17 has two systems, namely, a first oil pressure passage 34 and a second oil pressure passage 35. The first oil pressure passage 34 supplies the oil pressure to and drains the oil pressure from advanced angle chamber 26, by way of a first inner passage (of supply-drain passage shaft 33) and first radial hole 30. The second oil pressure passage 35 supplies the oil pressure to and drains the oil pressure from retarded angle chamber 27, by way of a second inner passage (of supply-drain passage shaft 33) and second radial hole 31. First oil pressure passage 34 and second oil pressure passage 35 are connected to a supply passage 36 and a drain passage 37, by way of an electromagnetic switch valve 38 for switching oil pressure passage (namely, case 1. 35 to 38 to 36, and 34 to 38 to 37; and case 2.35 to 38 to 37, and 34 to 38 to 36).

Also shown in FIG. 1 include an oil pan 39, an oil pump 40, and an ECU 41, where ECU stands for electrical control unit. ECU 41 receives rotation signals from cam shaft 11 and crank shaft (not shown), and other signals such as those for showing operating conditions (load, temperature, and the like) of the internal combustion engine.

Lock gear 18 is constituted of a lock pin 43, a spring 44, a retainer 45, and a lock hole 46. Lock pin 43 is movably (forward and backward) received in a pin hole 42 which is formed axially along one vane section 25 of vane rotor 16. Spring 44 is housed in pin hole 42, and biases lock pin 43 in a direction toward front cover 20. Retainer 45 is housed in pin hole 42, and supports an end (opposite to front cover 20) of spring 44. Lock hole 46 is disposed inside front cover 20, and mates with a head end (left in FIG. 1) of lock pin 43 when vane rotor 16 is at an initial position (where vane rotor 16 is at a most retarded angle relative to housing 14).

Pin hole 42 extends from a first end (right in FIG. 1) defining rear cover 21 to a second end (left in FIG. 1)

defining front cover 20, in such a manner as to be reduced in diameter stepwise. A stepped face 49 connects a small diameter hole 47 (deflected toward front cover 20) with a large diameter hole 48 (deflected toward rear cover 21). Stepped face 49 is so inclined as to form an obtuse-angle edge and an obtuse-angle corner on an inner periphery, to thereby form a taper.

On the other hand, lock pin 43 is constituted of a small diameter section 50 and a large diameter section 51. Small diameter section 50 is positioned at a head end (leftward in FIG. 1), and is inserted in small diameter hole 47 of pin hole 42. Large diameter section 51 is positioned at a base end (rightward in FIG. 1) of small diameter section 50, and is inserted in large diameter hole 48 of pin hole 42. Large diameter section 51 is larger in diameter than small diameter section 50, in such a manner as to form a flange.

Moreover, small diameter section 50 has a head end (left in FIG. 1) which is formed with a protrusion 52 to be inserted in lock hole 46. Protrusion 52 is shaped substantially into a cone with its vertex cut off. Lock pin 43 has two pressure faces, namely, a head end face (left in FIG. 1) of protrusion 52, and a stepped side face between large diameter section 51 and small diameter section 50. An unlock oil pressure is adapted to be applied to the above two pressure faces.

A bottom section of lock hole 46 communicates to advanced angle chamber 26, by way of a first unlock passage 53. An annular space 54 is formed between stepped face 49 of pin hole 42, and large diameter section 51 of lock pin 43. Annular space 54 communicates to retarded angle chamber 27, by way of a second unlock passage 55. From a condition that lock pin 43 mates with lock hole 46, an increased oil pressure in advanced angle chamber 26 may act on the head end (left in FIG. 1) of protrusion 52, in such a manner as to move lock pin 43 backward (rightward in FIG. 1). Moreover, an increased oil pressure in retarded angle chamber 27 may act on a side face (left in FIG. 1) of large diameter section 51, likewise, in such a manner as to move lock pin 43 backward (rightward in FIG. 1).

According to the first embodiment, unlock gear 23 is constituted of first unlock passage 53, annular space 54, second unlock passage 55 and the like. As is seen in FIG. 1 and FIG. 3, first unlock passage 53 communicates to the bottom section of the lock hole 46; annular space 54 is defined between pin hole 42 and lock pin 43; and second unlock passage 55 communicates to annular space 54. Moreover, there is formed a space on a back side (right in FIG. 1) of large diameter section 51 of lock pin 43. The space communicates to atmosphere by way of a drain groove 56 formed in vane rotor 16, as is seen in FIG. 1.

Herein, there is defined a predetermined clearance between an inner periphery (of pin hole 42), and lock pin 43. With the clearance, lock pin 43 can assuredly mate with lock hole 46 when vane rotor 16 and housing 14 are at the initial position (where vane rotor 16 is at the most retarded angle relative to housing 14). According to the first embodiment, however, there are defined different clearances. More specifically, there are defined a first clearance d1 between large diameter section 51 and an inner periphery (of large diameter hole 48), and a second clearance d2 between small diameter section 50, and an inner periphery (of small diameter hole 47). As is seen in an enlarged circle in FIG. 1, first clearance d1 is larger than second clearance d2.

Hereinafter described is an operation of valve timing control system 10, according to the first embodiment of the present invention.

At the starting of the internal combustion engine, lock pin 43 of lock gear 18 mechanically locks vane rotor 16 and housing 14 in a condition that vane rotor 16 is at the retarded rotational angle relative to housing 14. Rotational force of the crank shaft (not shown) is conveyed to cam shaft 11 in the above condition. Thereby, failure, namely, flapping of vane rotor 16 to housing 14 can be prevented, which flapping may be caused by a torque reactive force attributable to the drive cam (not shown) and a valve spring (not shown). As a result, cam shaft 11 can open and close the intake valve at a retarded timing.

With the internal combustion engine thus started, the operation oil supplied to retarded angle chamber 27 can be increased gradually. Thereby, the pressure of retarded angle chamber 27 is applied to each of vane sections 25 of vane rotor 16, to thereby push vane section 25 toward retarded angle. On the other hand, the pressure of the same retarded angle chamber 27 is also applied to large diameter section 51 of lock pin 43, to thereby move large diameter section 51 backward. Herein, at least lock pin 43 is easily removed from lock hole 46, although some settings do not allow lock pin 43 to be removed completely from lock hole 46.

As is seen in the enlarged circle in FIG. 1, there are defined first clearance d1 and second clearance d2 between the inner periphery (of pin hole 42 for receiving lock pin 43) and lock pin 43. Thereby, lock pin 43 mates with lock hole 46 with an inclination formed relative to each other, as the case may be. Even in this case, however, an edge E of large diameter section 51 is free from abutting on the inner periphery of pin hole 42 when the oil pressure is applied to lock pin 43 for unlocking, as is seen in FIG. 3. The above 'free from abutting' of the edge E is attributable to the following constitution:

Clearance d1 {defined between large diameter section 51, and the inner periphery (of large diameter hole 48)} is larger than clearance d2 {defined between small diameter section 50, and the inner periphery of (small diameter hole 47)}, as is seen in the enlarged circle in FIG. 1.

In other words, when lock pin 43 is inclined, inequality d1>d2 allows small diameter section 50 of lock pin 43 to abut at first on the inner periphery of pin hole 42 (small diameter hole 47), as is seen in FIG. 3, leaving large diameter section 51 of lock pin 43 free from abutment on the inner periphery of pin hole 42.

Thereafter, the internal combustion engine is increased in speed. Then, operating electromagnetic switch valve 38 allows supply passage 36 to communicate to advanced angle chamber 26 while drain passage 37 to communicate to retarded angle chamber 27. Then, the operation oil (high pressure) conveyed to advanced angle chamber 26 may act on protrusion 52 at the head end (left in FIG. 1) of lock pin 43, by way of first unlock passage 53. With the operation oil (high pressure), lock pin 43 may move backward (rightward in FIG. 1) in pin hole 42. Thereby, the mechanical lock (of housing 14 and vane rotor 16) by means of lock gear 18 is completely unlocked, to thereby move vane rotor 16 toward the advanced angle side with the pressure of advanced angle chamber 26 applied to vane rotor 16. As a result, cam shaft 11 is allowed to open and close the intake valve at an advanced timing.

Thereafter, when the internal combustion engine is about to stop operation from the above condition, the torque reactive force attributable to the drive cam (not shown) and the valve spring (not shown) so acts that vane rotor 16 can be returned to the most retarded angle relative to housing 14. Thereby, spring 44 biases lock pin 43 so that lock pin 43 can engage with lock hole 46. As a result, valve timing control system 10 is maintained in a lock condition for the next starting of the internal combustion engine.

When vane rotor 16 is shifted to the most retarded angle relative to housing 14, an axial center of pin hole 42 is not completely in accordance with an axial center of lock hole 46. The above "not completely" is seen in most cases. Even in this case, however, lock pin 43 is guided by a taper face of lock hole 46, and is properly movable in a range of clearance d2 around an axial center of the lock pin 43. Thereby, lock pin 43 can assuredly mate with lock hole 46.

Hereinafter described are other embodiments, where parts and sections substantially the same as those in FIG. 1 to FIG. 3 according to the first embodiment are denoted by the same numerals, and repeated descriptions are omitted.

Figure 4:
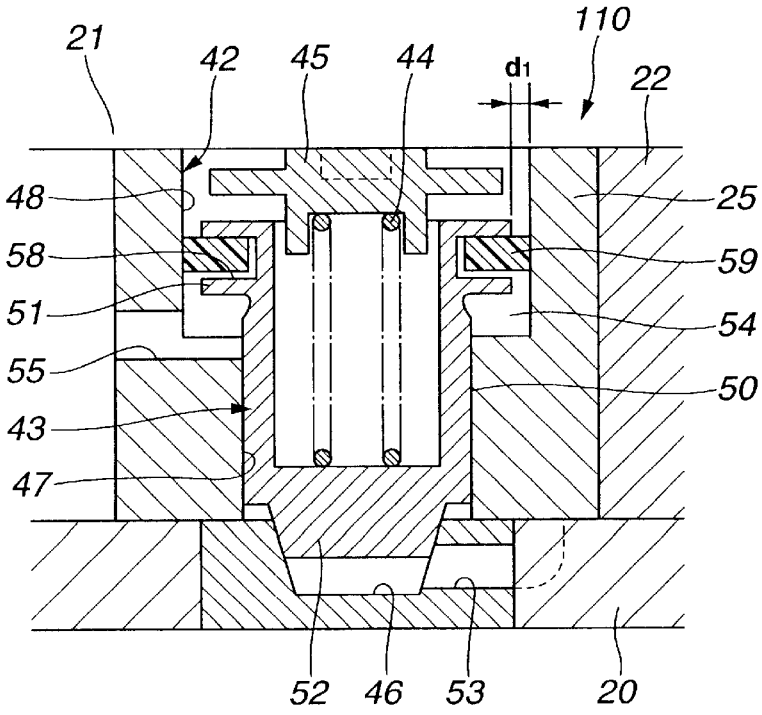
FIG. 4 is a cross section of a valve timing control system 110 (corresponding to FIG. 3), according to a second embodiment of the present invention.
Figure 5:
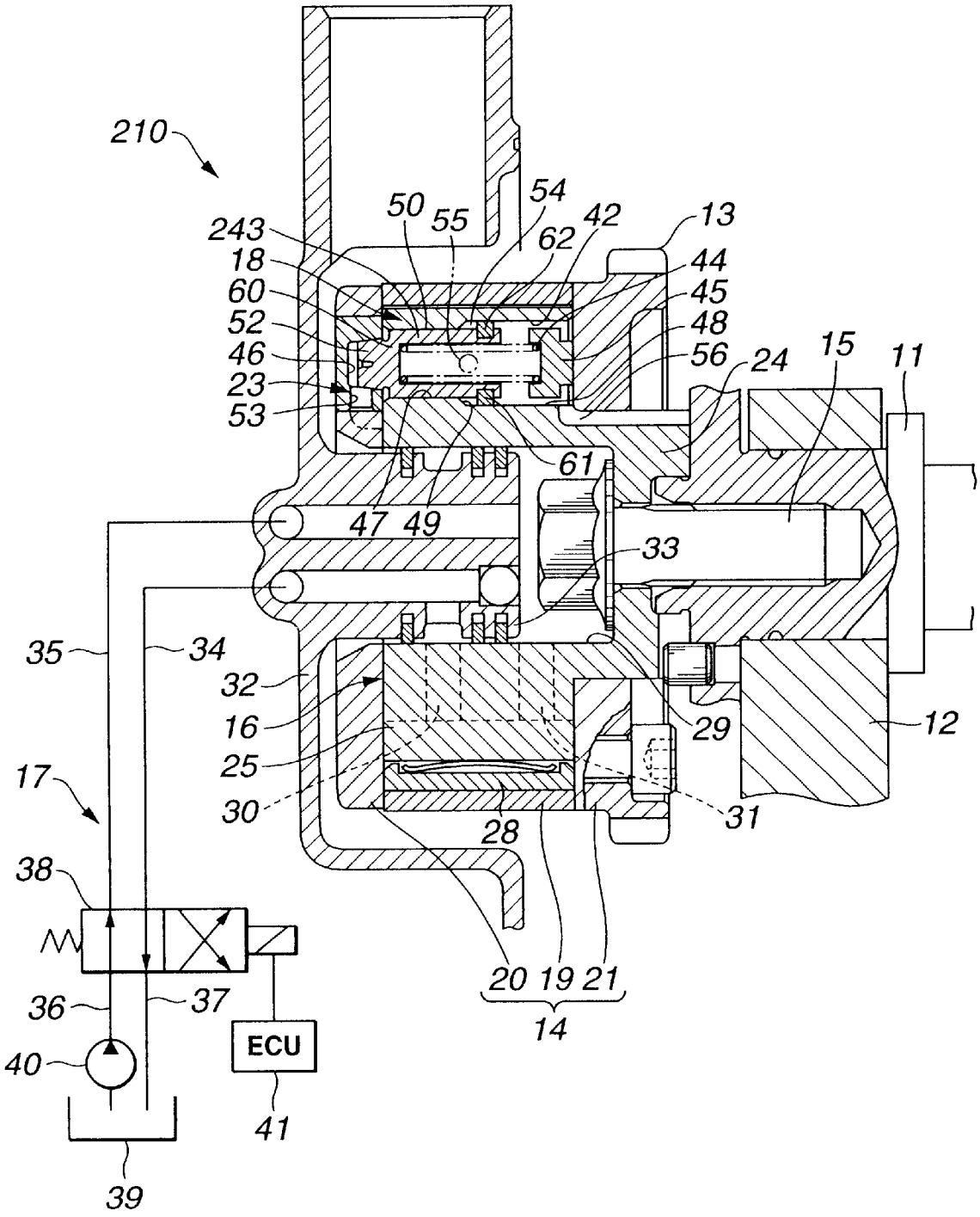
FIG. 5 is a cross section of a valve timing control system 210 (corresponding to FIG. 1), according to a third embodiment of the present invention.

As is seen in FIG. 4, there is provided a valve timing control system 110, according to a second embodiment of the present invention.

The valve timing control system 110 according to the second embodiment is different from the valve timing control system 10 according to the first embodiment in the following points:

In valve timing control system 110, an outer periphery of large diameter section 51 of lock pin 43 is formed with an annular groove 58. A seal ring 59 (referred to as "seal member" in WHAT IS CLAIMED IS) made of resin, rubber and the like mounts to annular groove 58 in such a manner as to closely abut on the inner periphery of pin hole 42.

Basically, valve timing control system 110 according to the second embodiment can bring about substantially the same effect and operation as those of valve timing control system 10 according to the first embodiment. According to the second embodiment, however, seal ring 59 can help assuredly prevent the operation oil from leaking from a circumference of large diameter section 51 of lock pin 43. Thereby, lock pin 43 can be unlocked more rapidly and assuredly.

As is seen in FIG. 5 to FIG. 8, there is provided a valve timing control system 210, according to a third embodiment of the present invention.

Basically, valve timing control system 210 is substantially the same in constitution as the valve timing control system 10 according to the first embodiment. Valve timing control system 210 has, however, a lock pin 243 that is greatly different from lock pin 43 according to the first embodiment.

More specifically, lock pin 243 has a lock pin body 60. Lock pin body 60 is made of metal material, and has small diameter section 50. Small diameter section 50 is inserted in small diameter hole 47 of pin hole 42. Lock pin body 60 extends from small diameter section 50 to a bottom end (rightward in FIG. 5), in such a manner as to form substantially a straight and constant outer diameter. The bottom end of lock pin body 60 has an outer periphery which is formed with an annular groove 61. There is provided a ring member 62 made of resin, metal and the like, featuring small expansion/contraction. Ring member 62 is mounted to annular groove 61 in such a manner as to constitute a large diameter section of lock pin 243.

Figure 6:
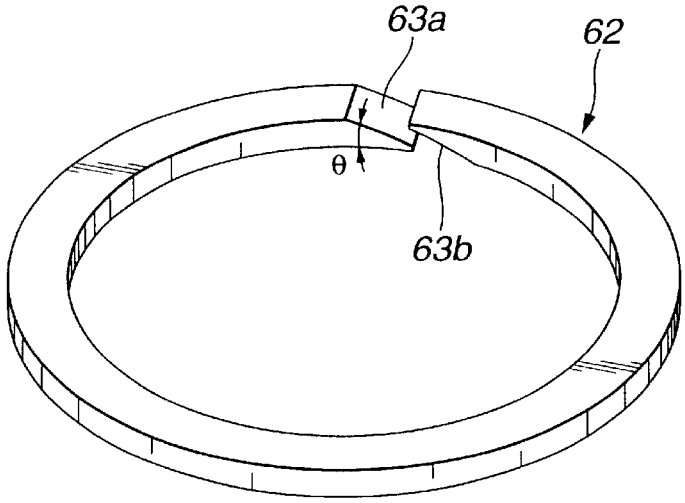
FIG. 6 is a perspective view of a ring member 62, according to the third embodiment.

As is seen in FIG. 6, ring member 62 is partly separated, and is, therefore, formed substantially into alphabetical "C". A first end and a second end thus separated are, respectively, formed into a first mating face 63*a* and a second mating face 63*b*. Each of first mating face 63*a* and second mating face 63*b* is so tapered as to form an inclination θ relative to a surface perpendicular to an axis of ring member 62. Ring member 62 has resilience (resilient force) in a direction for increasing in diameter. Before being inserted in pin hole 42, ring member 62 has first mating face 63*a* and second mating face 63*b* slightly spaced apart from each other.

Figure 7:
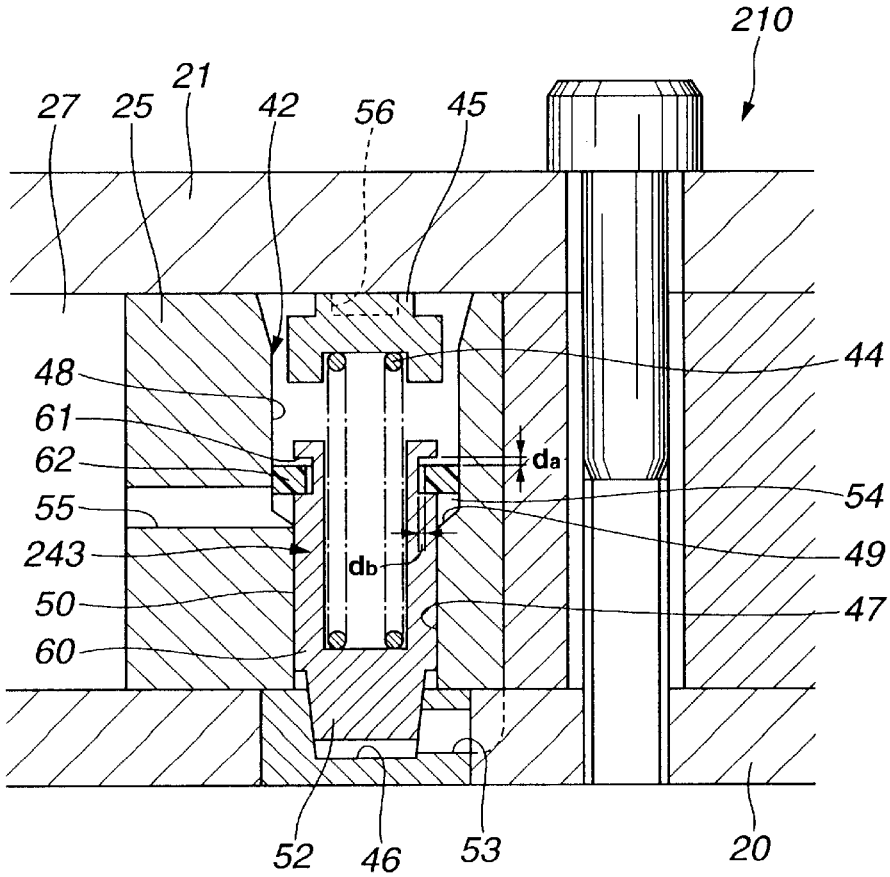
FIG. 7 is a first aspect of a cross section (corresponding to FIG. 3), according to the third embodiment.
Figure 8:
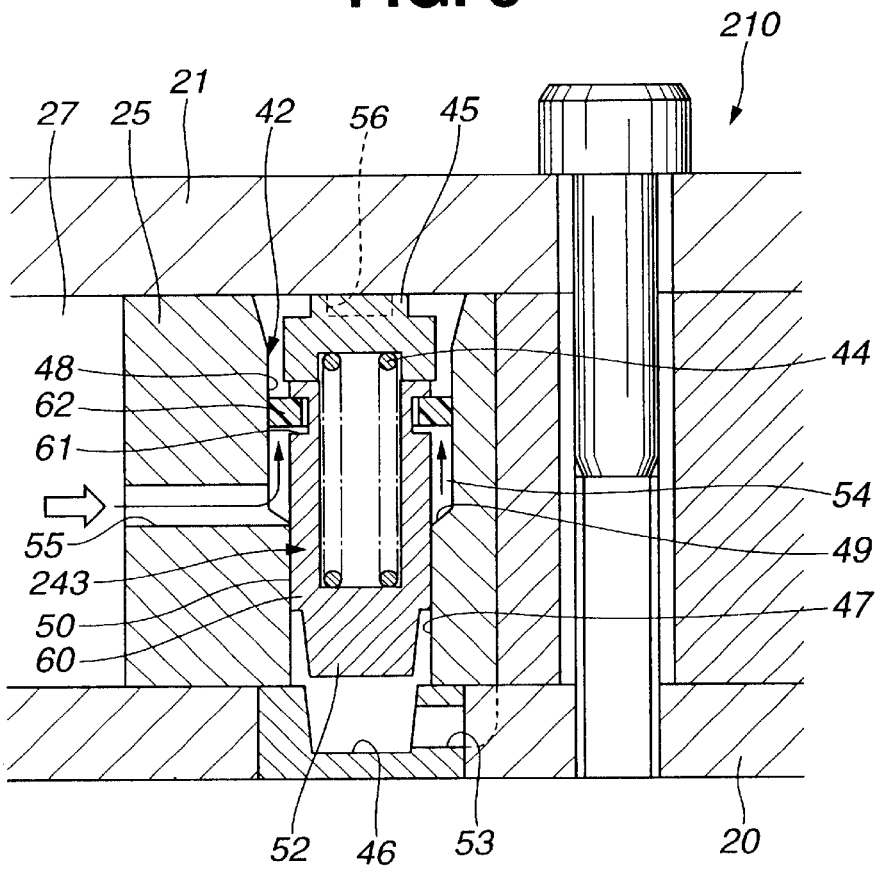
FIG. 8 is a second aspect of the cross section (corresponding to FIG. 3), according to the third embodiment.

By slightly opening the space between first mating face 63*a* and second mating face 63*b* in such a manner as to increase ring member 62 in diameter, ring member 62 can be mounted in annular groove 61 of lock pin body 60. Thereby, ring member 62 and lock pin body 60 can be inserted in large diameter hole 48 of pin hole 42. Ring member 62 thus inserted in large diameter hole 48 is reduced in diameter such that first mating face 63*a* and second mating face 63*b* abut on each other. Under this condition, an axial clearance $d_a$ and a radial clearance $d_b$ are defined between ring member 62 and an inner periphery (of annular groove 61), as is seen in FIG. 7.

When annular space 54 is low in pressure (in other words, when the oil pressure conveyed from retarded angle chamber 27 to annular space 54 by way of second unlock passage 55 is low), ring member 62 may abut on the inner periphery of large diameter hole 48 only by its radial resilient force in the direction for increasing in diameter.

Contrary to this, when a high pressure operation oil is conveyed to annular space 54, the high pressure is applied to a side face (lower in FIG. 7) of ring member 62, and an inner periphery of the ring member 62. Then, ring member 62 is pushed to a side wall (upper in FIG. 7) of annular groove 61 and to the inner periphery of large diameter hole 48. The above is summarized as follows:

When the high pressure operation oil is conveyed from retarded angle chamber 27 to annular space 54, a force corresponding to the high pressure operation oil can assuredly prevent the operation oil from leaking from a circumference of ring member 62. Thereby, lock pin 243 can be rapidly and assuredly moved toward an unlocking direction.

Moreover, although ring member 62 continuously abuts on the inner periphery of large diameter hole 48, ring member 62 may be reduced in diameter in a range of radial clearance db around an axial center of the ring member 62. Thereby, when lock pin 243 mates with lock hole 46, a radial shift of lock pin 243 is allowed in such a manner as to absorb axial deflection of pin hole 42 from lock hole 46.

As the case may be, lock pin 243 mates with lock hole 46 with an inclination, causing a stress concentrated on an edge of ring member 62. The stress can be, however, assuredly eased by a resilient deformation (in a direction for reducing in diameter) of ring member 62. Thereby, a back end (upper in FIG. 7) of lock pin 243 can be prevented from abutting on the inner periphery of pin hole 42, which abutment (failure) may be caused when lock pin 243 is moved backward (upward in FIG. 7).

The above summarizes that according to the third embodiment, lock pin 243 can be smoothly operated during unlocking.

Moreover, ring member 62 is made of resin, metal and the like, featuring small expansion/contraction. Thereby, when the operation oil (pressure) is applied from annular space 54 to ring member 62, ring member 62 can instantaneously seal annular groove 61 and large diameter hole 48, without expansion/contraction. From this point of view as well, lock pin 243 can be smoothly operated during unlocking.

Moreover, being tapered, first mating face 63*a* and second mating face 63*b* of ring member 62 can continuously maintain abutment on each other even when ring member 62 is radially deformed. The above abutment can assuredly prevent the operation oil from leaking from between first mating face 63*a* and second mating face 63*b*.

Especially, according to the third embodiment, as is seen in FIG. 6, ring member 62 has the side faces (upper and lower in FIG. 6) each of which is larger in area than the inner periphery. Thereby, the pressure of the operation oil in annular space 54 acts on ring member 62, more greatly, as axial pressing force which is applied to the tapers of first mating face 63*a* and second mating face 63*b*. With this, first mating face 63*a* and second mating face 63*b* push each other axially. The above summarizes that the axial pressing force by the operation oil accelerates prevention of the operation oil from between first mating face 63*a* and second mating face 63*b*.

Moreover, valve timing control system 210 has the following constitution: Lock pin body 60 is substantially straight from small diameter section 50 to the base end (upper in FIG. 7). The outer periphery at the base end of lock pin body 60 is formed with annular groove 61 to which ring member 62 (separate) is mounted. The thus mounted ring member 62 constitutes the large diameter section.

Thereby, for forming lock pin 243 from the metal material during production, the following cutting is, for example, carried out:

1. Prepare a substantially cylindrical metal material which is substantially the same in diameter as small diameter section 50.
2. Cut the metal material so as to form protrusion 52 at the head end, and annular groove 61.

Contrary to the above, according to the first embodiment and the second embodiment, small diameter section 50 and protrusion 52 are formed by cutting the metal material which is substantially the same in diameter as large diameter section 51. Compared with the first embodiment and the second embodiment, the third embodiment can bring about good yield as well as easy cutting, to thereby produce lock pin 243 at reduced cost.

Figure 9:
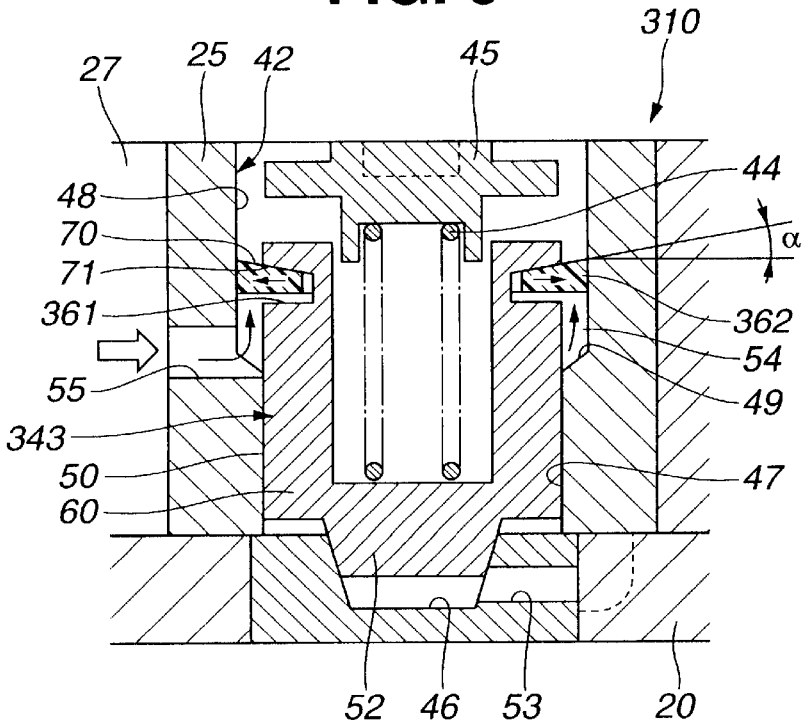
FIG. 9 is a cross section of a valve timing control system 310 (corresponding to FIG. 1), according to a fourth embodiment of the present invention.
Figure 10:
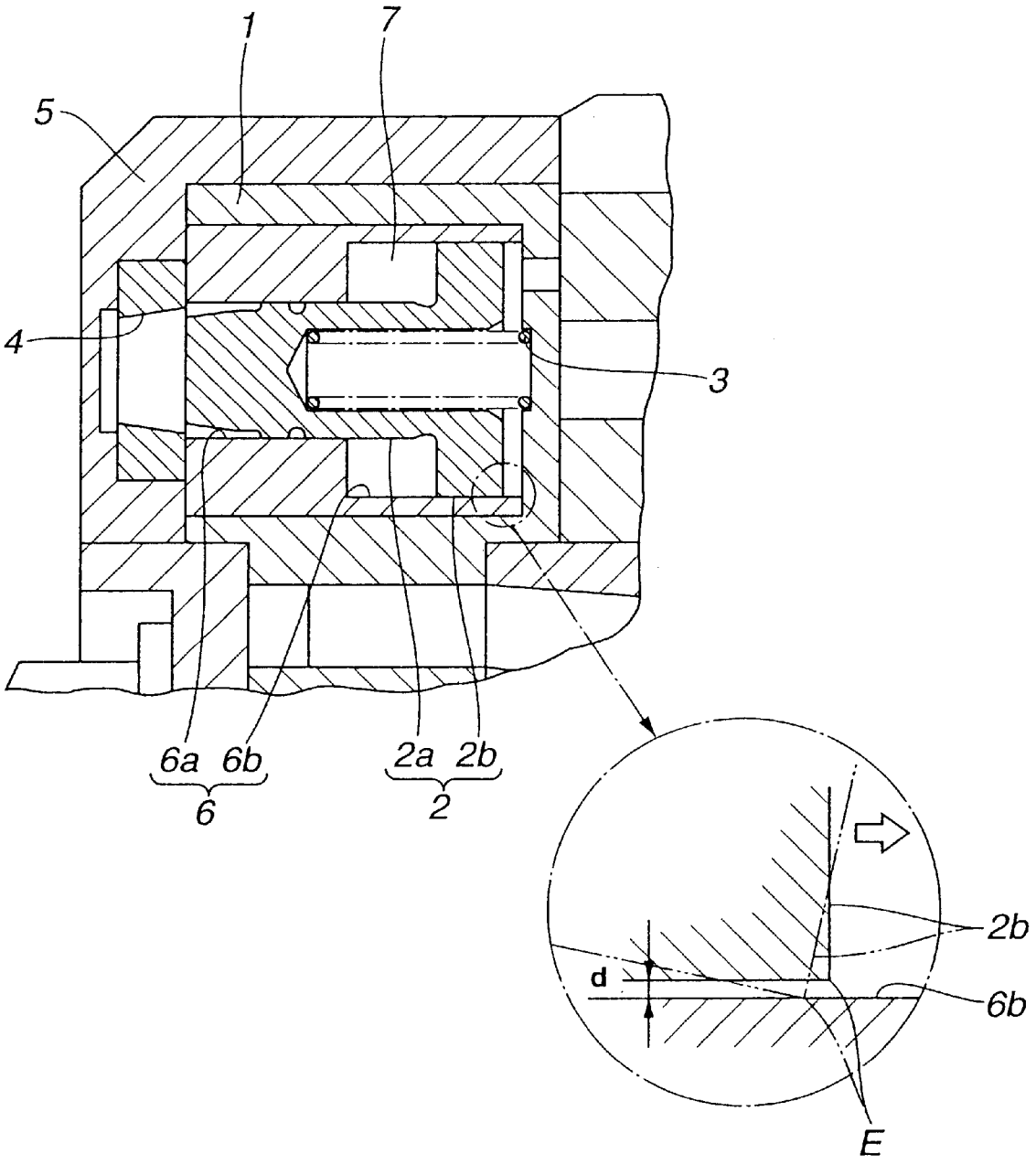
FIG. 10 PRIOR ART
FIG. 10 is a cross section of a valve timing control system, according to a related art.

As is seen in FIG. 9, there is provided a valve timing control system 310, according to a fourth embodiment of the present invention.

Basically, valve timing control system 310 is substantially the same in constitution as the valve timing control system 210 according to the third embodiment. Valve timing control system 310 has, however, a ring member 362 and an annular groove 361 (of a lock pin 343) which are a little different in shape, respectively, from ring member 62 and annular groove 61 (of lock pin 243) according to the third embodiment.

More specifically, ring member 362 has two side faces axially. One is a side face 70 (referred to as "abutting face" in WHAT IS CLAIMED IS) which is disposed opposite to annular space 54. Side face 70 is not perpendicular to the axis. Instead, side face 70 is so made as to form a taper having a predetermined angle $\alpha$ relative to a surface perpendicular to the axis. The taper thus formed by side face 70 has such an inclination that side face 70 is more spaced apart radially outwardly from annular space 54. Annular groove 361 of lock pin 343 has a side face 71 (referred to as "abutting face" in WHAT IS CLAIMED IS) which is so made as to form a taper corresponding to the taper formed by side face 70 of ring member 362.

Basically, valve timing control system 310 according to the fourth embodiment can bring about substantially the same effect and operation as those of valve timing control system 210 according to the third embodiment. Valve timing control system 310 can, however, further bring about the following effect and operation, with the constitution described above.

Effect and operation: Valve timing control system 310 has side face 70 (of ring member 362) and side face 71 (of annular groove 361) which are so made as to form the tapers. Thereby, applying the pressure from annular space 54 to ring member 362 so that ring member 362 can be pressed on side face 71 allows ring member 362 to be pushed radially outwardly along the taper formed by side face 71. As a result, ring member 362 is pushed strongly on the inner periphery of large diameter hole 48. Therefore, according to the fourth embodiment, ring member 362 can be pressed on large diameter hole 48 with a greater force than the third embodiment, to thereby more assuredly prevent the operation oil from leaking from a circumference of ring member 362.

Although the present invention has been described above by reference to four embodiments, the present invention is not limited to the four embodiments described above. Modifications and variations of the four embodiments described above will occur to those skilled in the art, in light of the above teachings.

The entire contents of basic Japanese Patent Application No. P2001-122046 (filed on Apr. 20, 2001) of which priority is claimed is incorporated herein by reference.

The scope of the present invention is defined with reference to the following claims.

What is claimed is:

1. A valve timing control system of an internal combustion engine, comprising:

a drive force conveyer driven by a crank shaft of the internal combustion engine;

a cam shaft having an outer periphery formed with a drive cam for driving a valve of the internal combustion engine, the drive force conveyer being mounted to the cam shaft in such a manner as to make a rotation relative to the cam shaft when so requested, the cam shaft receiving a drive force from the drive force conveyer to rotate as a follower;

a housing rotating integrally with one of the drive force conveyer and the cam shaft;

a vane rotor housed in the housing, the vane rotor rotating integrally with the other of the drive force conveyer and the cam shaft;

an advanced angle chamber and a retarded angle chamber housed in the housing, and turning the vane rotor with an oil pressure;

an oil pressure supply-drain measure for supplying the oil pressure to the advanced angle chamber and the retarded angle chamber and for draining the oil pressure from the advanced angle chamber and the retarded angle chamber, the oil pressure supply-drain measure carrying out the supplying and the draining of the oil pressure selectively for the advanced angle chamber and the retarded angle chamber;

a lock gear formed with a lock hole, the lock gear including a lock pin having a small diameter section and a large diameter section, the lock pin received in a pin hole in such a manner as to emerge and submerge, the pin hole being formed in one of the vane rotor and the housing, the lock pin having a head end adapted to engage with the lock hole which is formed in the other of the vane rotor and the housing, the head end and the lock hole, when thus engaged, locking a relative rotation of the vane rotor and the housing at one of a most retarded angle and a most advanced angle; and an unlock gear for disengaging the lock pin from the lock hole with the oil pressure conveyed from one of the advanced angle chamber and the retarded angle chamber to a pressure face of the lock pin;

wherein the pin hole includes:

a head side on which the lock pin is engaged with and disengaged from, the head side forming a small diameter hole, and a bottom side opposite to the head side, and forming a large diameter hole which is larger than the small diameter hole;

wherein the lock pin includes:

a small diameter section on a head side of the lock pin, the small diameter section being disposed toward the lock hole, and a large diameter section on a bottom side of the lock pin opposite to the head side of the lock pin, the large diameter section being increased in diameter in such a manner as to form a stepped face relative to the small diameter section;

wherein the pressure face of the lock pin includes:

a face defined on a head side of the small diameter section, and subjected to the oil pressure from the one of the advanced angle chamber and the retarded angle chamber, and the stepped face of the large diameter section, the stepped face facing the small diameter section and being subjected to the oil pressure from the other of the advanced angle chamber and the retarded angle chamber; and wherein the large diameter section of the lock pin and an inner periphery of the pin hole define a first clearance while the small diameter section of the lock pin and the inner periphery of the pin hole define a second clearance, such that the first clearance is larger than the second clearance.

2. The valve timing control system of the internal combustion engine as claimed in claim 1, wherein the large diameter section of the lock pin is provided with a seal member which is radially deformable and closely abuts on the inner periphery of the pin hole.

3. A valve timing control system of an internal combustion engine, comprising:

a drive force conveyer driven by a crank shaft of the internal combustion engine;

a cam shaft having an outer periphery formed with a drive cam for driving a valve of the internal combustion engine, the drive force conveyer being mounted to the cam shaft in such a manner as to make a rotation relative to the cam shaft when so requested, the cam shaft receiving a drive force from the drive force conveyer to rotate as a follower;

a housing rotating integrally with one of the drive force conveyer and the cam shaft;

a vane rotor housed in the housing, the vane rotor rotating integrally with the other of the drive force conveyer and the cam shaft;

an advanced angle chamber and a retarded angle chamber housed in the housing, and turning the vane rotor with an oil pressure;

an oil pressure supply-drain measure for supplying the oil pressure to the advanced angle chamber and the retarded angle chamber and for draining the oil pressure from the advanced angle chamber and the retarded angle chamber, the oil pressure supply-drain measure carrying out the supplying and the draining of the oil pressure selectively for the advanced angle chamber and the retarded angle chamber;

a lock gear formed with a lock hole, the lock gear including a lock pin having a small diameter section and a large diameter section, the lock pin received in a pin hole in such a manner as to emerge and submerge, the pin hole being formed in one of the vane rotor and the housing, the lock pin having a head end adapted to engage with the lock hole which is formed in the other of the vane rotor and the housing, the head end and the lock hole, when thus engaged, locking a relative rotation of the vane rotor and the housing at one of a most retarded angle and a most advanced angle; and an unlock gear for disengaging the lock pin from the lock hole with the oil pressure conveyed from one of the advanced angle chamber and the retarded angle chamber to a pressure face of the lock pin;

wherein the pin hole includes:

a head side on which the lock pin is engaged with and disengaged from, the head side forming a small diameter hole, and a bottom side opposite to the head side, and forming a large diameter hole which is larger than the small diameter hole;

wherein the lock pin includes:

a small diameter section on a head side of the lock pin, the small diameter section being disposed toward the lock hole, and a large diameter section on a bottom side of the lock pin opposite to the head side of the lock pin, the large diameter section being increased in diameter in such a manner as to form a stepped face relative to the small diameter section;

wherein the pressure face of the lock pin includes:

a face defined on a head side of the small diameter section, and subjected to the oil pressure from the one of the advanced angle chamber and the retarded angle chamber, and the stepped face of the large diameter section, the stepped face facing the small diameter section and being subjected to the oil pressure from the other of the advanced angle chamber and the retarded angle chamber; and wherein the lock pin comprises:

a lock pin body extending from the small diameter section on the head side of the lock pin, in such a manner as to form substantially a straight and constant outer diameter, the bottom side of the lock pin having an outer periphery formed with an annular groove; and a ring member mounted to the annular groove in such a manner as to constitute a large diameter section of the lock pin, the ring member having a resilient force in a direction for increasing the ring member in diameter and being deformable in a direction for reducing the ring member in diameter.

4. The valve timing control system of the internal combustion engine as claimed in claim 3, wherein the ring member is made of a material which features an expansion and a contraction smaller than an expansion and a contraction of the lock pin, and the ring member is partly separated circumferentially, in such a manner as to form a first mating face and a second mating face, each of the first mating face and the second mating face constituting a taper.

5. The valve timing control system of the internal combustion engine as claimed in claim 4, wherein an axial clearance and a radial clearance are defined between the ring member and an inner periphery of annular groove.

6. The valve timing control system of the internal combustion engine as claimed in claim 5, wherein an abutting face of the ring member and an abutting face of the annular groove abut axially on each other with an unlocking oil pressure conveyed from one of the retarded angle chamber and the advanced angle chamber, and each of the abutting face of the ring member and the abutting face of the annular groove constitutes a taper so as to be more spaced apart radially outwardly from a side subjected to the unlocking oil pressure.

7. The valve timing control system of the internal combustion engine as claimed in claim 3, wherein the ring member has two side faces each of which is larger in area than an inner periphery of the ring member.

8. A valve timing control system of an internal combustion engine, comprising:

a drive force conveyer driven by a crank shaft of the internal combustion engine;

a cam shaft having an outer periphery formed with a drive cam for driving a valve of the internal combustion engine, the drive force conveyer being mounted to the cam shaft in such a manner as to make a rotation relative to the cam shaft when so requested, the cam shaft receiving a drive force from the drive force conveyer to rotate as a follower;

a housing rotating integrally with one of the drive force conveyer and the cam shaft;

a vane rotor housed in the housing, the vane rotor rotating integrally with the other of the drive force conveyer and the cam shaft;

an advanced angle chamber and a retarded angle chamber housed in the housing, and turning the vane rotor with an oil pressure;

an oil pressure supply-drain measure for supplying the oil pressure to the advanced angle chamber and the retarded angle chamber and for draining the oil pressure from the advanced angle chamber and the retarded angle chamber, the oil pressure supply-drain measure carrying out the supplying and the draining of the oil pressure selectively for the advanced angle chamber and the retarded angle chamber;

a lock gear formed with a lock hole, the lock gear including a lock pin having a small diameter section and a large diameter section, the lock pin received in a pin hole in such a manner as to emerge and submerge, the pin hole being formed in one of the vane rotor and the housing, the lock pin having a head end adapted to engage with the lock hole which is formed in the other of the vane rotor and the housing, the head end and the lock hole, when thus engaged, locking a relative rotation of the vane rotor and the housing at one of a most retarded angle and a most advanced angle; and an unlock gear for disengaging the lock pin from the lock hole with the oil pressure conveyed from one of the advanced angle chamber and the retarded angle chamber to a pressure face of the lock pin;

wherein the pin hole includes:

a head side on which the lock pin is engaged with and disengaged from, the head side forming a small diameter hole, and a bottom side opposite to the head side, and forming a large diameter hole which is larger than the small diameter hole;

wherein the lock pin includes:

a small diameter section on a head side of the lock pin, the small diameter section being disposed toward the lock hole, and a large diameter section on a bottom side of the lock pin opposite to the head side of the lock pin, the large diameter section being increased in diameter in such a manner as to form a stepped face relative to the small diameter section;

wherein the pressure face of the lock pin includes:

a face defined on a head side of the small diameter section, and subjected to the oil pressure from the one of the advanced angle chamber and the retarded angle chamber, and the stepped face of the large diameter section, the stepped face facing the small diameter section and being subjected to the oil pressure from the other of the advanced angle chamber and the retarded angle chamber; and wherein the large diameter section of the lock pin is radially movable relative to the pin hole in a range wider than the small diameter section of the lock pin is radially movable relative to the pin hole.

9. The valve timing control system of the internal combustion engine as claimed in claim 8, wherein an inner periphery of the lock hole is formed substantially into a taper for guiding the lock pin.

10. The valve timing control system of the internal combustion engine as claimed in claim 8, wherein the ring member is made of a resin.

11. The valve timing control system of the internal combustion engine as claimed in claim 8, wherein the head end of the small diameter section of the lock pin is formed substantially into a cone with a vertex of the small diameter section cut off.

12. The valve timing control system of the internal combustion engine as claimed in claim 11, wherein the head end of the small diameter section of the lock pin cut substantially into the cone is a protrusion.

13. The valve timing control system of the internal combustion engine as claimed in claim 8, wherein the large diameter section of the lock pin has a back side which faces a space communicating to an atmosphere.

14. The valve timing control system of the internal combustion engine as claimed in claim 8, wherein the lock pin is biased by a spring in a direction toward the lock hole.

* * * * *